United States Patent [19]

Rantanen

[11] 4,308,769

[45] Jan. 5, 1982

[54] REVERSING RATCHETING WRENCH

[75] Inventor: Alfonso W. Rantanen, Watton, Mich.

[73] Assignees: Bertha Rantanen; Karen Hansen; Roger Rantanen; Cindy Christensen, all of Watton, Mich.

[21] Appl. No.: 155,524

[22] Filed: Jun. 2, 1980

[51] Int. Cl.[3] ..... B25B 13/46

[52] U.S. Cl. ..... 81/63

[58] Field of Search ..... 81/60–63.2

[56] References Cited

U.S. PATENT DOCUMENTS 2,758,569 8/1956 Peterson ..... 81/61

3,867,855 2/1975 Siebert ..... 81/63.1

4,254,675 3/1981 Marlow et al. ..... 81/63

FOREIGN PATENT DOCUMENTS 809746 10/1951 Fed. Rep. of Germany ..... 81/62

*Primary Examiner*—James L. Jones, Jr.

*Attorney, Agent, or Firm*—Recka & Joannes

[57] ABSTRACT

A reversing ratchet wrench employing spring biased linkage connecting a pivotally mounted pawl to a finger operated reciprocally worked finger piece mounted in the end of the wrench body opposite the ratcheting mechanism wherein the change of direction of the wrench action is accomplished by depressing a finger piece or by releasing the finger piece.

3 Claims, 7 Drawing Figures

REVERSING RATCHETING WRENCH

BACKGROUND OF THE INVENTION

This invention relates to the field of ratcheting wrenches. Such wrenches are used with various size sockets to fit nuts or bolt heads. The wrenches have in common a ratchet gear and a reversing pawl. The pawl is pivotable and can engage the ratchet in two alternative positions. Rotating the wrench handle in one direction about an axis normal to the ratchet gear, causes the gear to be held by the pawl and the ratchet with its attached socket turned; while turning the handle in the opposite direction causes the ratchet to turn relatively freely giving the characteristic ratcheting click as the ratchet teeth overide the pawl. Reversal of direction is generally accomplished by means of a lever directly attached to the pawl gear. Turning the lever one way allows clockwise turning of the socket and its driven bolt, the other way counterclockwise turning of the socket and its driven bolt.

SUMMARY OF THE INVENTION

A need exists for a reversing ratcheting wrench in which reversing can be done while the wrench is being used in close quarters and where the normally mounted switch lever, directly connected to the pawl, could not be reached. Further in freeing rust frozen nuts and bolts a need exists for a wrench that can be reversed in a rapid manner. Reversing mechanisms exist that require rotating motion of a reversing mechanism mounted at the handle end of the wrench.

Further an object of this invention is to provide a reversing wrench in which the reversing can be done with one finger on the operating hand by means of a straight line reciprocating motion.

It is further object of this invention to make a reversing linkage that can be easily made without extensive machining within a wrench and which mechanism can be easily removed for repair.

DESCRIPTION OF THE PREFERRED EMBODIMENT

Figure 1:
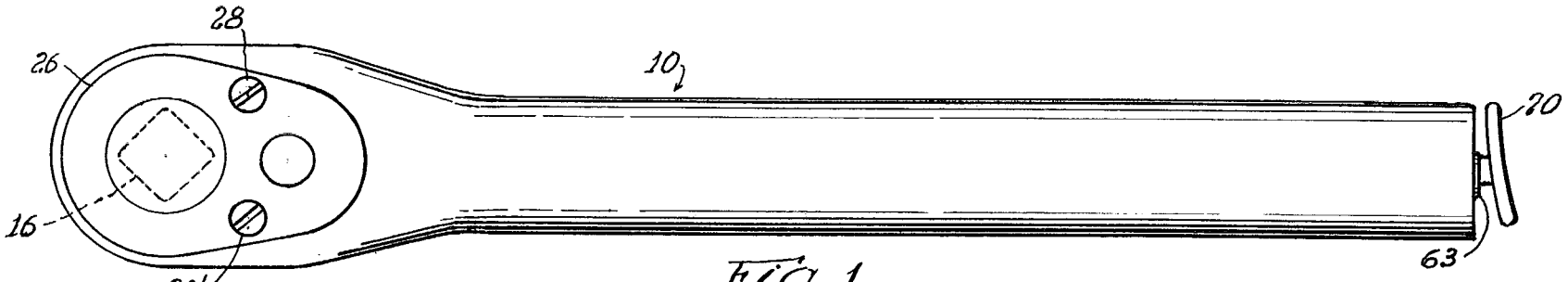
FIG. 1 is a top view of an assembled wrench showing at one end the socket receiving portion of the wrench and at the other end the operating piece.

Referring more particularly to the drawing by characters of reference, FIGS. 1—7 show a reversing ratcheting wrench, in which reversal is effectuated by an end of handle reciprocally operated finger piece comprising a wrench body 10 having at one end a ratchet housing bore 12 and a pawl housing bore 18; within ratchet housing bore 12 is inserted ratchet gear 14', ratchet gear 14 having ratchet gear teeth 15; ratchet gear 14 is rotatably mounted within ratchet housing bore 12; extending through the wrench body 10 is ratchet gear socket drive member 16, within pawl housing bore 18, pawl 20 is inserted, with the pawl teeth 21, addressing ratchet gear teeth 15; pawl 20 is pivotably mounted within pawl housing bore 18; the pawl 20 is slotted on said pawl body opposite the pawl teeth 21 with pivoting slot 22; within the wrench body 10 is a wrench linkage passage 24 through which the linkage necessary to pivot the pawl 20 is mounted.

Ratchet gear 14 and pawl 20 are retained within ratchet gear housing bore 12 and pawl housing bore 18 by the bottoms of such bores and by gear retaining plate 26; such gear retaining plate screws 28 and 28' which screw into gear retaining plate screw holes 30 and 30' which are drilled into wrench body 10;

Reversal of nut driving direction of the drive member 16 is caused by engaging the pawl 20, by pivoting the pawl 20 until it engages ratchet gear teeth 15.

As stated above to provide for reversing direction of the drive member, pawl 20 is pivotably mounted; the linkage used to pivot pawl 20, into selective engagement with the gear teeth 15, comprises pawl link pin 32, which is mounted in a hole dilled through pawl 20 the axis of such hole being normal to the axis of rotation of pawl 20 and being on one side of the pawl 20; connected to such pawl 20 by pawl link pin 32 is hook shaft 34; hook shaft 34 is pivotally connected to pawl 20 by said pawl link pin 32; the hook shaft 34 is slidably mounted within hook shaft sleeve 45 with the amount of sliding travel limited by and defined by hook shaft operating slots 44 and 44', within hook shaft sleeve 45 is hook shaft compression spring 42, said spring being retained by hook shaft spring retaining pin hole 40; this spring biased mechanism allows the ratchet 14 to turn relatively freely in a clockwise direction with minimal resistance, while urging the pawl into engagement with ratchet gear teeth 15, when the wrench is turned in a counterclockwise direction, the spring biasing 15, giving the audible clicking noise characteristic of ratcheting wrenches.

The hook shaft sleeve 45 is pivotally connected to push rod 63, push rod 63 is also spring biased, by push rod biasing spring 52; the push rod sleeve 46 has machined in its circumference push rod sleeve locking notch 48, the second spring biasing means accomplished the relatively free turning when the wrench is turned in a counterclockwise direction.

Push rod 63 passes through push rod sleeve 46 through push rod aperture 50, push rod 63 is forced outward towards the distal end of the wrench by push rod biasing spring 52; the assembled linkage is held within the wrench body 10 by retaining screws 56 and 56'; these pass through push rod retaining spring screw holes 54 and 54' and into the wrench body 10;

Push rod pivot pin 60 pivotally connects push rod 63 and hook shaft sleeve 45; mounted within a slot 74 within push rod 63 is operating piece 64; operating piece 64 has at one end closest to the drive gear, locking hook 68, at the distal end it has finger piece 70; operating piece 64 is pivotally connected to push rod 63 by operating piece pivot pin 66.

In use, when the finger piece 70 is pushed down and into the wrench body 10 by a force on that end of the finger piece 70 opposite locking hook 68, both springs 52 and 42 are compressed and locking hook 68 is forced through push rod sleeve locking notch 48, which holds such springs in compression and locks the finger piece 70 in and which pushes the whole hook shaft sleeve 45 toward the ratchet end and the wrench spring 42 through hooks shaft sleeve 45 toward the ratchet end of the wrenchy, spring 42 through hook shaft 34 forces pawl 20 into engagement with ratchet gear 14; this engages pawl 20 and ratchet gear teeth 15 allowing counterclockwise driving of a nut; pushing on finger piece 70 on the same side as the locking hook 68 causes the hook 68 to disengage from the push rod sleeve locking notch 48 forcing push rod 63 out of the end of the wrench through the linkage described herein and thereby pulling pawl 20 out of one engagement with the ratchet gear 14 and into the opposite engagement; in switching enegagement that end of hook shaft 34 attached to pawl 20 moves sideways through pawl pivoting groove 22.

Figure 2:
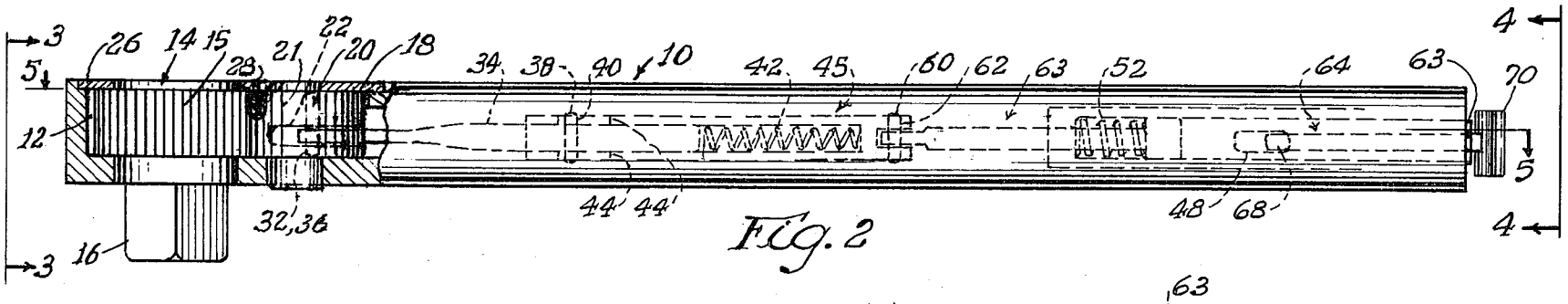
FIG. 2 is an edge view of an assembled wrench partly broken away to show part of the opposed spring biasing mechanism.
Figure 4:
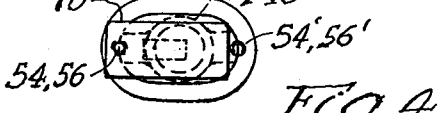
FIG. 4 is a view of FIG. 2 taken along line 4—4 showing the end of the wrench.
Figure 3:
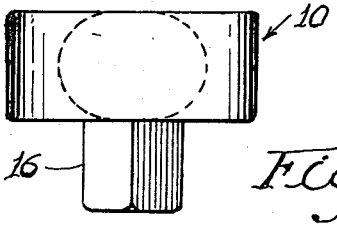
FIG. 3 is a view taken along line of 3—3 of FIG. 2.

FIG. 2 shows hook shaft compression spring 42, which mounted in hook shaft sleeve 45 forces hook shaft 34 outward and towards ratchet gear teeth 15. FIG. 2 also shows push rod biasing spring 52 which forces push rod 63 outward and towards the end of the wrench body 10.

The springs 42 and 52 provide with the hook shaft operating slots 44 and 44' and hook shaft retaining pin 38 the means to pivot pawl 20 into selective engagement with ratchet gear teeth 15 while providing the necessary small amount of movement to allow the gear teeth 15 to override the pawl 20 when turned in the non locking direction.

Figure 5:
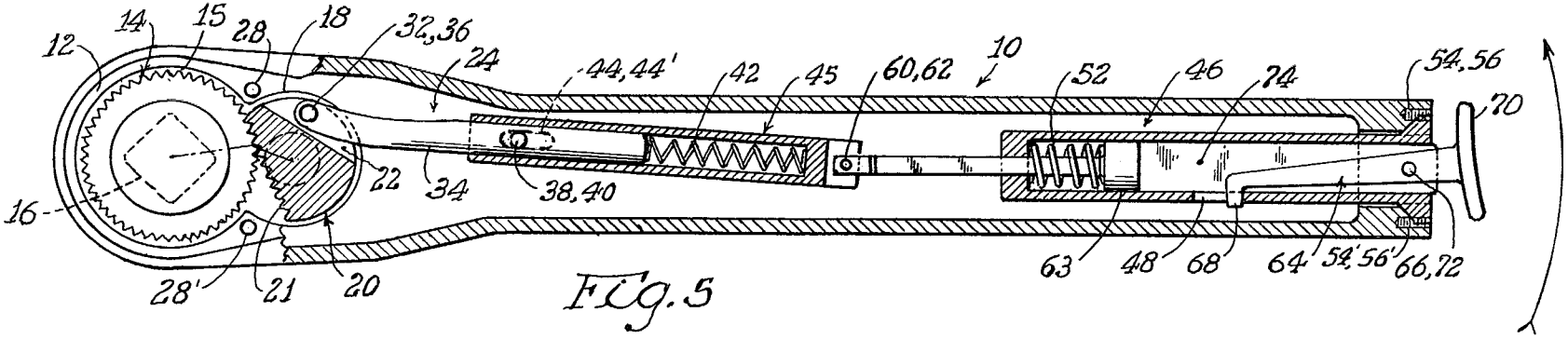
FIG. 5 is a section through the wrench along line 5—5 showing the wrench set for counterclockwise driving of a nut.

For example in FIG. 5, the wrench is adjusted to drive a nut in a counterclockwise direction and to rotate relatively freely in a clockwise direction. Push rod 63 is forced inwardly by operating piece 64, locking hook 68 is engaged in and retained by rod sleeve locking notch 48 and push rod biasing spring 52 is compressed within its housing; hook shaft 34 is urged outward forcing pawl 20 into engagement with ratchet gear teeth 15, Clockwise turning of the wrench so adjusted, causes gear teeth 15 to force the pawl 20 outward against the pressure of hook shaft compression spring 42, as the pawl is moved outward, hook shaft retaining pin 38 moves outward also, while being retained in hook shaft operating slots 44 and 44' allowing the movement necessary to relatively free turning of the ratchet in the unlocked direction.

Figure 6:
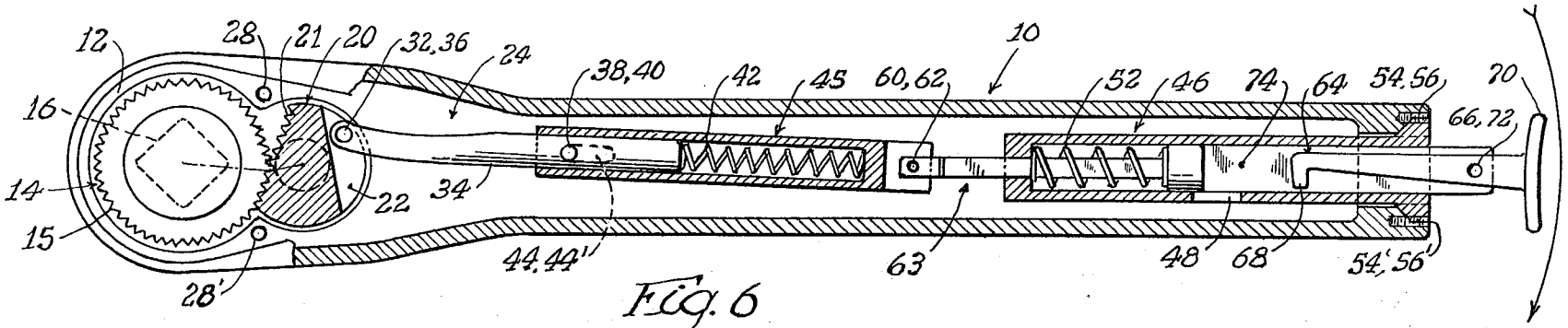
FIG. 6 is the same section as in FIG. 5 but with direction of ratcheting reversed.
Figure 7:
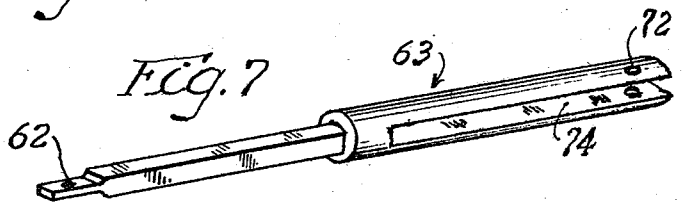
FIG. 7 is a perspective view of the pushrod.

FIG. 6 shows the wrench adjusted to drive a nut in a clockwise direction and to rotate relatively freely in a counterclockwise direction.

Push rod 63 is released and forces outwardly towards the distal end of the wrench by push rod biasing spring 52; this in turn pulls the hook shaft sleeve 45 and its attached hook shaft 34 outward causing the pawl 20 to pivot. Counterclockwise turning of the wrench so adjusted causes pawl 20 to be overriden by the gear teeth 15, the resistance to counterclockwise turning being provided by the extended push rod biasing spring 52 transmitted through the hook shaft retaining pin 38 in the hook shaft operating slots 44 and 44'.

Rapid reversal of direction of turn of the socket is done by first pushing inwardly on one side of the finger piece 70 and then on the other side. Operation of the wrench including rapid reversal can be done with one hand and one finger or the thumb.

By releasing locking hook 68 through pushing on the finger piece 70 on the same side as the locking hook 68 and holding the push rod 63 half way down against the pawl 20 is not engaged and a socket attached to the main gear socket drive member 16 can be rapidly tightened or loosened by hand.

I claim:

1. A reversing ratcheting wrench comprising:

a wrench body having a handle portion at one end and a socket receiving portion at the other end;

a ratchet gear rotatably mounted in said socket receiving portion;

a pawl pivotally mounted in said body for oscillatory movement relative to said ratchet gear;

a first spring means pivotally connected to said pawl for forcing the pawl into engagement with the ratchet gear;

a push rod pivotally connected to said first spring means;

a second spring means operatively connected to said push rod forcing said rod outward toward the end of said handle portion;

a reciprocating operating piece operatively connected to said push rod for selective engagement of said pawl.

2. A reversing ratcheting wrench comprising:

a wrench body having a handle portion at one end and a socket receiving portion at the other end;

a ratchet gear rotatably mounted in said socket receiving portion;

a pawl pivotally mounted in said body for oscillatory movement relative to said ratchet gear;

a shaft pivotally connected to said pawl;

a first spring biasing means operatively connected to said shaft urging said shaft toward the pawl for forcing the pawl into engagement with the ratchet gear;

a push rod pivotally connected to said first spring biasing means;

a second spring biasing means operatively connected to said push rod for forcing said rod toward the end of said handle portion;

a reciprocating operating piece having a finger piece at one end and a locking hook at the other end, pivotally connected to the push rod;

locking means for engaging such locking hook.

3. A reversible ratching wrench having a handle portion at one end and a socket receiving portion at the other end said socket receiving portion having a ratchet gear rotatably mounted therein and a pawl pivotally mounted therein for oscillatory motion with respect to said ratchet for selectively engaging said ratchet gear;

wherein the improvement comprises:

a shaft pivotally connected to said pawl;

a first spring biasing means operatively connected to said shaft urging said pawl into engagement with the ratchet gear;

a push rod pivotally connected to said first spring biasing means;

a second spring biasing means operatively connected to said push rod urging said push rod toward the end of the handle portion;

a reciprocating operating piece having a finger piece at one end and a locking hook at the other end, such operating piece being pivotally connected to the push rod and locking means for engaging such locking hook.

* * * * *